United States Patent [19]

Strubel et al.

[11] Patent Number: 4,681,126

[45] Date of Patent: Jul. 21, 1987

[54] PROCESS FOR MANUFACTURING RECONSTITUTED TOBACCO

[75] Inventors: David G. Strubel, Jeffersontown; Robert A. Sanford, Prospect, both of Ky.

[73] Assignee: Brown & Williamson Tobacco Corporation, Louisville, Ky.

[21] Appl. No.: 889,669

[22] Filed: Jul. 28, 1986

Related U.S. Application Data

[63] Continuation of Ser. No. 612,166, May 21, 1984, abandoned.

[51] Int. Cl.[4] ..... A24B 3/14

[52] U.S. Cl. ..... 131/370; 131/355; 131/356

[58] Field of Search ..... 131/370, 355, 353, 373, 131/375, 374, 356

[56] References Cited

U.S. PATENT DOCUMENTS

| | | | |
|---|---|---|---|
| 2,845,933 | 8/1958 | Samfield et al. | 131/355 |
| 2,887,414 | 5/1959 | Rosenberg et al. | 131/355 |
| 3,012,562 | 12/1961 | Merritt | 131/370 |
| 3,364,935 | 1/1968 | Moshy et al. | 131/370 |
| 3,379,198 | 4/1968 | Mold et al. | 131/370 |
| 3,435,829 | 4/1969 | Hind et al. | 131/370 |
| 3,795,250 | 3/1974 | Halter | 131/370 |
| 3,983,884 | 10/1970 | Detert et al. | 131/370 |
| 4,306,578 | 12/1981 | Schmidt et al. | 131/353 |
| 4,421,126 | 12/1983 | Gellatly | 131/373 |

*Primary Examiner*—V. Millin
*Assistant Examiner*—H. Macey
*Attorney, Agent, or Firm*—Charles G. Lamb

[57] ABSTRACT

A process for manufacturing reconstituted tobacco from tobacco stems and tobacco fines includes treating the tobacco stems to a fibrous form, and mixing the fibrous tobacco stems with tobacco lamina fines. The mixture is then deposited on a moving mesh screen whereon it is formed into a felt-like mat or sheet of generally uniform thickness. The reconstituted tobacco sheet is then removed from the mesh screen for further processing to produce a tobacco smoking article.

18 Claims, 4 Drawing Figures

PROCESS FOR MANUFACTURING RECONSTITUTED TOBACCO

This application is a continuation, of application Ser. No. 612,166, filed May 21, 1984, now abandoned.

BACKGROUND OF THE INVENTION

1. Field of the Invention

This invention relates generally to a method of producing a reconstituted tobacco. More particularly, this invention relates to a method of manufacturing reconstituted tobacco which is simpler, requires less energy and minimizes the treatment on tobacco, thus, preserving the natural flavor and taste characteristics of the tobacco materials used to make reconstituted tobacco.

2. Discussion of the Prior Art

During the manufacture of tobacco products such as cigarettes, cigars, pipe tobacco, a portion of the tobacco is broken up and therefore too small to be used in the tobacco product. The stems and veins are also by-products removed from the tobacco leaves purchased from the grower. It has been the general practice of tobacco product manufacturers to process the fines and stems, and mixtures thereof, into reconstituted tobacco which is produced generally in a sheet-like form. The reconstituted tobacco is mixed with the tobacco and thereafter cut and incorporated into the tobacco products.

The manufacture of reconstituted tobacco has been practiced for many years. Most commercial processors involved in the manufacturer of reconstituted tobacco include a series of steps which consist of mixing the tobacco materials with water and grinding the materials to a smaller particle size to form a slurry. The slurry is then cast on an endless band and heated to remove the water. Binder material, such as Guar Gum, Methylcellulose, or Sodium Carboxymethylcellulose, is added to the slurry to assist in forming a coherent sheet. Further, it is known to use the so called "paper" process where the tobacco is extracted and the tobacco fibers are processed on conventional paper equipment and the fibers are formed into a sheet on conventional paper machines. The tobacco extract is concentrated and added back to the "paper" using a conventional sizing process. The sized reconstituted tobacco is then dried to remove excess water.

These conventional processes for manufacturing reconstituted tobacco treat the fine tobacco harshly. These treatments tend to change the flavor characteristics of the starting tobacco and depending on the temperature used in drying, drive off or change the natural tobacco characteristics.

These conventional processes for producing reconstituted tobacco also require large amounts of energy to remove the water used as the vehicle to cast the slurry in the form of steam energy. The present invention is a simpler process and should require less manpower to produce a reconstituted sheet material that heretofore known processes.

DESCRIPTION OF THE DRAWINGS

The invention will become even more clear upon reference to the accompanying drawings wherein like numerals refer to like parts throughout and in which.

DETAILED DESCRIPTION

Figure 1:
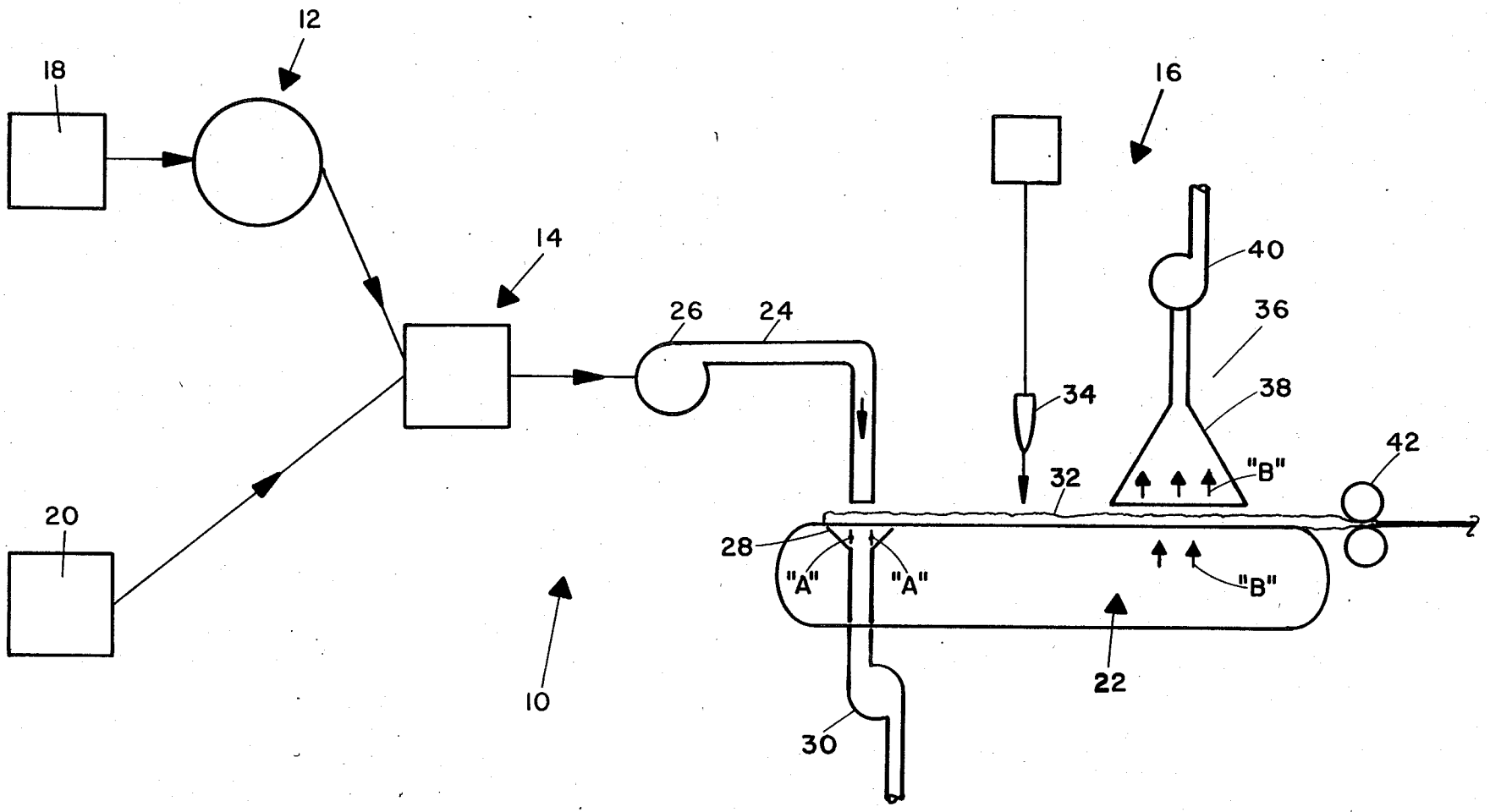
FIG. 1 is a schematic representation of a system for carrying out the process of the present invention.

FIG. 1 illustrates, in schematic format, a system, generally denoted as the numeral 10, for carrying out the process of the present invention for manufacturing reconstituted tobacco.

The system 10 comprises a fibrillation stage 12, a mixing stage 14, and a reconstituted tobacco sheet forming stage 16.

Tobacco stems are fed from a source of tobacco stems 18 to the fibrillation stage 12 wherein the particle size of the stems is reduced to a size suitable for use in a smoking article. The fibrillation stage 12 can include, for example, a hammer mill or a disc refiner.

Tobacco fines are fed from a source of tobacco fines 20 to the mixing stage 14, and the fibrillated stems are fed from the fibrillation stage 12 to the mixing stage 14. The tobacco fines and fibrillated tobacco stems are thoroughly mixed together in the mixing stage 14 to form a homogeneous mixture. The mixing stage 14 should be capable of not only mixing the fines and stems together, but also prevent clumping of the mixture. Toward this end, an air mixing device has been found to be advantageous for the mixing stage 14. The air mixing device utilizes an air stream to tumble and, thereby mix the tobacco fines and fibrillated stems, and break-up clumps of material.

The homogenous mixture of fines and fibrillated stems are then transferred to the sheet forming stage 16 for forming a mat of the mixture. As shown, the sheet forming stage 16 comprises a recticulated endless belt conveyor 22. The mixture of fines and fibrillated stems are fed to a preselected area on the top flight of the belt conveyor 22 in an air stream passing through a duct 24 communicating at one end with the mixing stage 14 and at the other end with the preselected area on the top flight of the belt conveyor 22. An air moving means 26, such as a blower, can be associated with the air duct 24 to generate the air stream through the duct 24 from the mixing stage 14 to the preselected area of the top flight of the belt conveyor 22. An air plenum chamber 28 is located beneath and open to the top flight of the belt conveyor 22 at the preselected area. A suction fan 30 is operatively associated with the plenum chamber 28 to create an air flow downwardly through the preselected area of the belt conveyor top flight into the plenum chamber 28 as indicated by the flow arrows "A". Preferrably, the air duct 24 directs the mixture of fines and fibrillated stems generally downwardly onto the preselected area of the belt conveyor top flight. As the mixture is deposited on the preselected area of the moving conveyor belt top flight, the air flow moving downwardly through the preselected area produces a relatively even distribution of the tobacco mixture, thus, forming a tobacco sheet 32 of generally uniform thickness on the belt conveyor top flight.

The tobacco sheet forming stage 16 can also include tobacco binder application means 34, such as spray nozzles, for directing a tobacco binder material onto the tobacco sheet 32 moving from the preselected area of the belt conveyor top flight. Further, drying means 36 is provided downstream, relative to the direction of travel of the belt conveyor top flight, of the binder application means 34 to aid in the rapid drying of the binder in the tobacco sheet 32 moving with the belt conveyor top flight. As illustrated, the drying means 36 includes a hood 38 located over the belt conveyor top flight by a distance adequate to allow the tobacco sheet 32 to pass therebeneath. An air flow, indicated by flow arrows "B", upwardly through the tobacco sheet 32 and into the hood 38 can be created by air moving means 40, such as a fan, in association with the hood 38.

Figure 2:
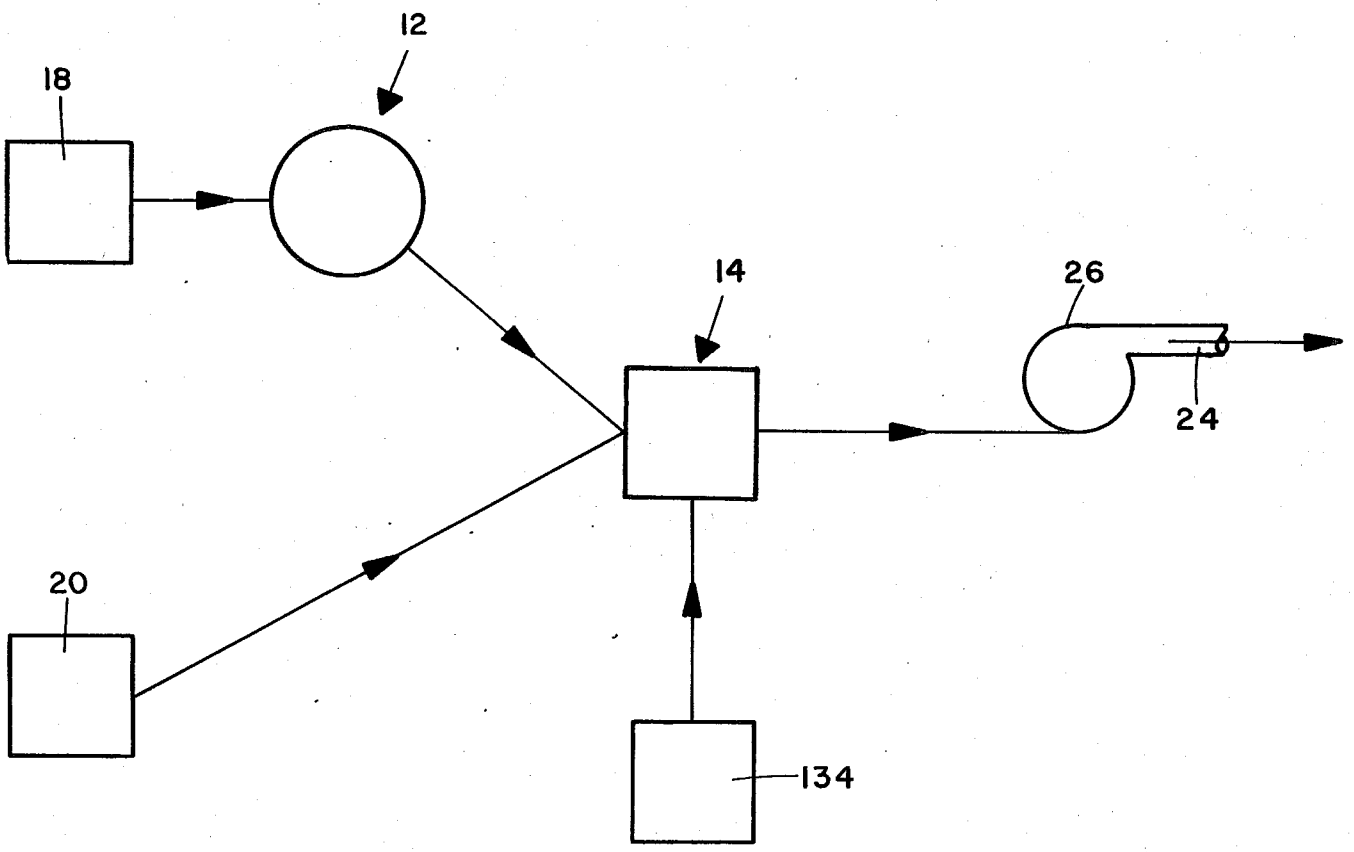
FIG. 2 is a schematic representation of another advantageous embodiment of a stage of the system of FIG. 1.

With reference to FIG. 2, it is contemplated that the binder material can be added to the tobacco fines and fibrillated tobacco stems being mixed in the mixing stage 14. This can be accomplished by supplying the binder from a source of binder 134, thus, eliminating the binder application means 34 at the belt conveyor 22.

As an additional option feature of the apparatus 10, calender rolls 42 can be provided along the path of the tobacco sheet 32 to further compress the tobacco sheet 32 to further reduce its thickness.

Figure 3:
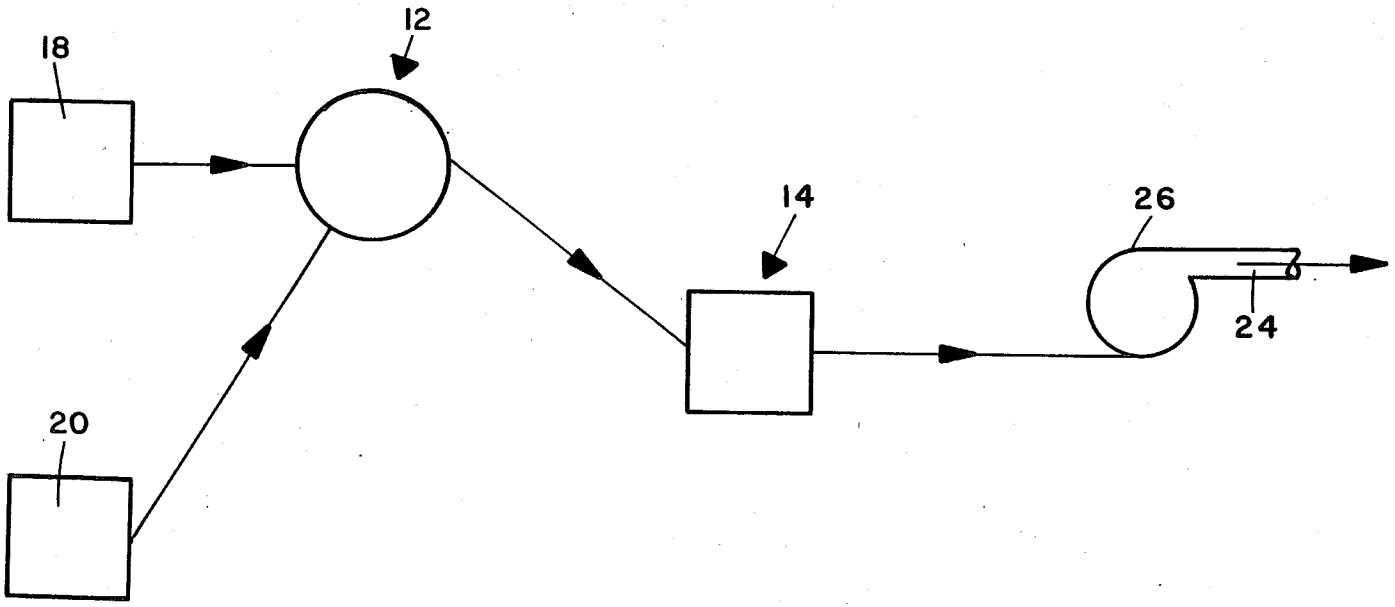
FIG. 3 is a schematic representation of a further advantageous embodiment of a stage of the system of FIG. 1; and, FIG. 4 is a schematic representation of yet another advantageous embodiment of a stage of the system of FIG. 1.

FIG. 3 illustrates a somewhat modified arrangement of the fibrillation stage 12 and mixing stage 14 of the apparatus 10. It is contemplated, as shown, that tobacco stems and tobacco fines can both be fed to the fibrillation stage 12 which would function not only to fibrillate the tobacco stems, but also function as a pre-mixer of the stems and fines. The premixture of fibrillated stems and fines would then be conveyed to the mixing stage 14 for more thorough mixing and for breaking up any clumps which may have formed in the mixture.

Figure 4:
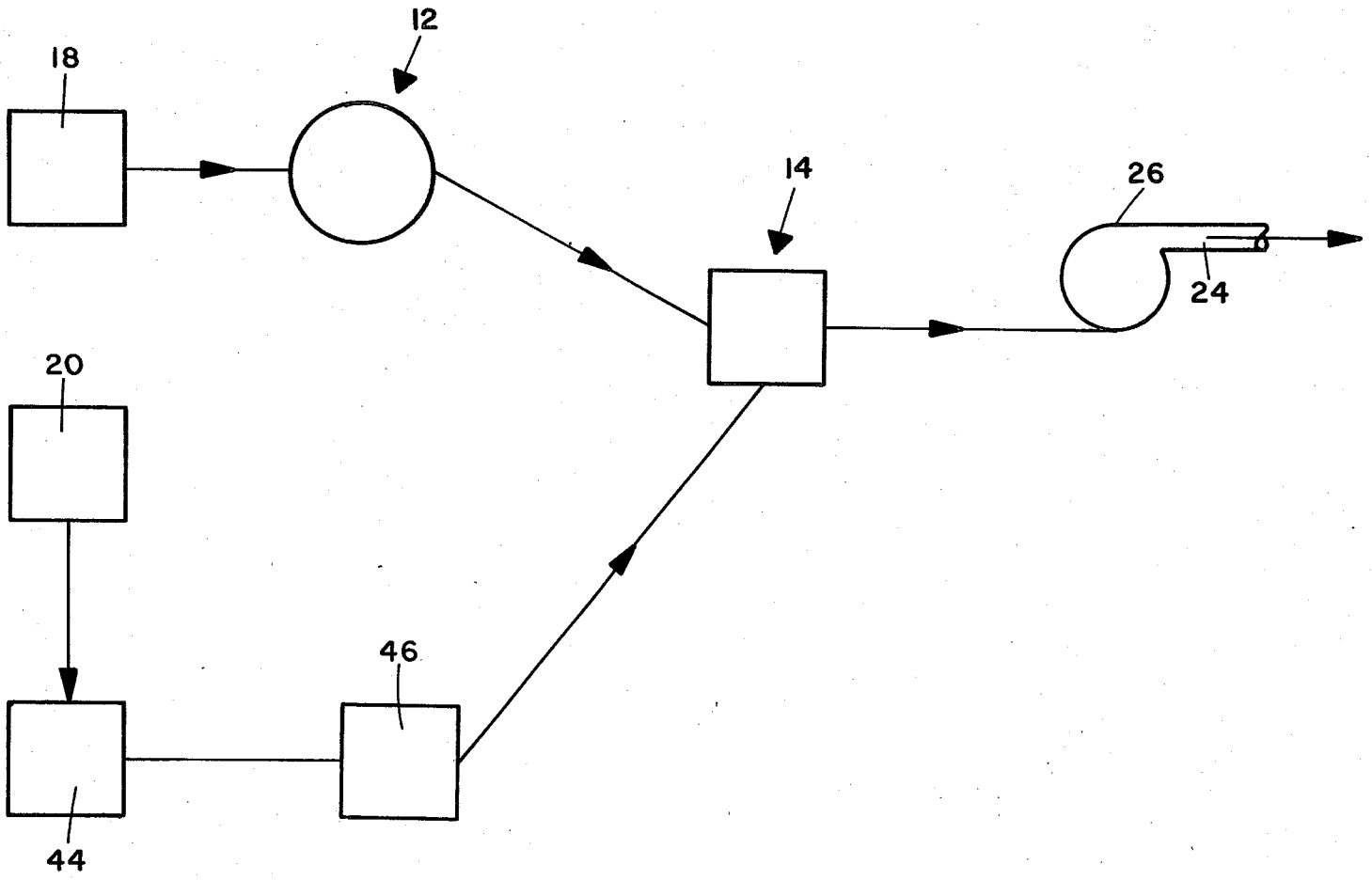

FIG. 4 illustrates another modification of the apparatus 10. In this embodiment, the tobacco fines are fed from the source of fines 20 to a treatment station 44. In the treatment station 44, the tobacco fines are treated to release pectine material which will function as a tobacco mixture binder. Toward this end, the tobacco fines can be mixed with diammonium phosphate, or pectic enzymes in the treating station 44. The treated tobacco fines are then transferred to a pulping station 46 wherein the treated fines are shredded. The shredded, treated tobacco fines are then fed from the pulping station 46 to the mixing stage 14 wherein it is thoroughly mixed with the fibrillated tobacco stems from the fibrillation stage 12 to form a homogenous mixture to be supplied to the tobacco sheet forming stage 16 for processing as hereinabove discussed.

It is further contemplated that non-tobacco extenders such as cellulose fiber and inorganic materials such as alumina will be added to the reconstituted tobacco in order to: (1) increase the volume of the reconstituted tobacco sheet without the need of using more tobacco components, and (2) modify the combustibility of the reconstituted tobacco sheet. The non-tobacco extenders can be incorporated into the tobacco components at virtually any step in the process. For example, the non-tobacco extenders can be added to the tobacco stems in the fibrillation stage 12, at the mixing stage 14 or at the sheet forming stage 16.

A wide variety of material or synthetic binders are suitable for use in the present invention provided that they are not inimical to the flavor of the tobacco. Specific examples of such suitable binders include natural vegetable gums such as, for example, gum arabic, gum tragacanth, guar gum, locust bean gum, etc. Other suitable gums include carbohydrate gums from animal sources, such as glycogen, deacetylated chitin and the like, marine plant gums such as algins, carageenans, and agar.

Preferred binders which are particularly advantageous in the method of the present invention include treated cellulosic gums, such as cellulose ethers, cellulose esters, and mixtures thereof. Specific example of such binders include methyl cellulose, ethyl cellulose, hydroxypropyl cellulose, methylhydroxyethyl cellulose, ethylhydroxyethyl cellulose, cellulose acetate, hydroxyethyl cellulose, sodium carboxymethyl cellulose, etc.

Specific examples of forming smoking tobacco material according to the process of the present invention are as follows:

EXAMPLE 1

A 50/50 mixture of flue-cured tobacco and burley tobacco stems having approximately 12 percent moisture content by weight were passed through a double disc refiner to produce a shredded product of highly fibrillated fibers. Twenty grams of this mixture was mixed with thirty grams of cigarette tobacco waste fines having a 12 percent moisture content by weight, five grams of flue-cured lamina fines of −14 mesh and having a 12 percent moisture content, and five grams of burley lamina fines of −14 mesh and having a 12 percent moisture content. The tobacco fines and the fibrillated tobacco stem mixture were tumbled together to evenly distribute the fibrillated stems throughout the mixture and to separate the intertwined bundles or clumps of stem fibers to form a homogenous mixture. The homogenous mixture was conveyed in an air stream to, and impacted on, a 170 U.S. mesh screen under which a vacuum of 21 inches of Hg. was applied. The homogenous mixture was thereby evenly distributed on the screen to a thickness of approximately 20 mils to form a sheet or mat of interlaced fibrillated stem fibers and tobacco fines. Twenty ml of a 5 percent solution of NaCMC Grade 7LF sold by Hercules Chemical Co. was then sprayed on the sheet as a binder. The sheet was next dried in a forced draft oven at 100° C. After the sheet of reconstituted tobacco was dried, it was mixed with regular strip tobacco and cut and formed into cigarettes.

EXAMPLE 2

A reconstituted tobacco sheet is prepared on a mesh screen as in Example 1. The tobacco sheet is removed from the screen and passed through a pair of calender rolls to reduce the sheet thickness from 20 mils to 10 mils. From the calender rolls, the tobacco sheet of reduced thickness is dried in a forced draft oven at 100° C. The dried sheet of reconstituted tobacco is then mixed with tobacco stems, cut, and formed into a cigarette.

EXAMPLE 3

Fifty grams of Pectic enzyme is dissolved in 300 grams of water. This solution is sprayed on 500 grams of flue-cured stems to raise the total moisture content of the stems to about 60 percent by weight. The enzyme treated stems are then maintained at about 25° C. for from 24 to 48 hours to allow the pectic enzyme to break down the pectin contained in the stems. The pectins are the "glue" which hold the fibers of the stems together. After the stems are treated for a sufficient length of time to break down and loosen the fibers, the stems are passed through a double disc refiner to produce fibrillated, individual fibers. Next, 100 grams of the flue-cured lamina fines are added to the 500 grams of fibrillated treated stems, and mixed together to uniformly distribute fibrillated stems and lamina fines and form a homogenous mixture. This homogenous mixture is then conveyed in an air stream to, and impacted on a mesh screen which has a vacuum chamber therebeneath. The vacuum created by the vacuum chamber beneath the homogenous mixture, and the force of impact of the tobacco mixture as it is blown on the screen cause the homogenous mixture to form into a felt-like sheet or mat of intertwined fibrillated tobacco stems with tobacco fines uniformly dispersed therethrough. The pectines liberated by the action of the pectic enzymes on the tobacco stems functioned as a "glue" to bond the intertwined, fibrillated tobacco stems and tobacco fines together and form a reconstituted tobacco sheet. The sheet of reconstituted tobacco is removed from the mesh screen and subjected to heated air at 100° C. for a sufficient time to reduce the moisture content to about 12 percent by weight. The reconstituted tobacco sheet is then passed through cutters to produce discreet particles which are added to cut leaf tobacco and formed into a cigarette.

EXAMPLE 4

A mixture of tobacco stem fibers and tobacco is prepared as in Example 1. To this mixture is added 20 gms. of cellulose fibers prepared in a similar manner as tobacco stems.

The resulting blend of tobacco and cellulose is then tumbled together to distribute the cellulose fibers uniformly. The mixture was then formed to a reconstituted tobacco in the same manner as in Example 1.

EXAMPLE 5

A portion of the mixture as per Example 4 is mixed with an additional 20 gms. alumina tri-hydrate ($Al_2O_3.3H_2O$) and that mixture is formed into an extended tobacco as per Example 1.

EXAMPLE 6

A reconstituted tobacco is prepared and formed as per Example 1. After the binder has been added, calcium carbonate ($CaCO_3$) is dusted on top. The sheet is then dried and removed from the wire as per Example 1.

EXAMPLE 7

A reconstituted tobacco mat is formed on a wire as per Example 1 but at only ½ the thickness. After the binder has been added, a second mixture prepared as per Example 5 is blown on top in a similar manner as per Example 1 to form a laminated sheet. The laminated sheet is then dried and removed from the wire as per Example 1.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A method for manufacturing reconstituted tobacco of tobacco stems and tobacco fines comprising:

a. treating the stem parts of tobacco is essentially a dry form to reduce the stem to substantially fibrous form;

b. mixing the fibrous stem with fine lamina tobacco;

c. conveying the mixture in an air stream and subsequently depositing the mixture of fibrous stem and fine lamina tobacco on a moving wire mesh continuous belt;

d. passing said air stream through the tobacco mixture on the wire mesh belt for homogenizing the fibrous stem and fine tobacco lamina throughout the mixture and causing intertwining of the fibrous stems and forming a continuous non-woven felt sheet of fibrous stem and fine lamina tobacco;

e. applying a binder to the non-woven felt sheet of fibrous stem and fine lamina tobacco as the felt sheet continues to move on the wire mesh belt;

f. drying the binder; and, g. removing said non-woven felt sheet of fibrous stem and fine lamina tobacco from the wire mesh belt in such a form for use in the manufacture of tobacco smoking articles.

2. The method of claim 1, wherein the binder material comprises treated cellulosic gum.

3. The method of claim 2, wherein the treated cellulosic gum is selected from the group consisting of:

cellulose ethers, cellulose esters, and mixtures thereof.

4. The method of claim 3, wherein the binder material is selected from the group consisting of:

methyl cellulose, ethyl cellulose, hydroxypropyl cellulose, methylhydroxyethyl cellulose, ethylhydroxyethyl cellulose, cellulose acetate, hydroxyethyl cellulose, and sodium carboxymethyl cellulose.

5. The method of claim 1, wherein the binder comprises a natural vegetable gum.

6. The method of claim 5, wherein the natural vegetable gum is selected from the group consisting of:

gum arabic, gum tragacanth, guar gum, locust bean gum, and mixtures thereof.

7. The method of claim 1, wherein the binder comprises carbohydrate gums.

8. The method of claim 7, wherein the carbohydrate gum is selected from the group consisting of:

glycogen, deaceteylated chitin, and mixtures thereof.

9. The method of claim 1, wherein the binder comprises a marine plant gum.

10. The method of claim 9, wherein the marine plant gum is selected from the group consisting of:

algins, carageenans, agar and mixtures thereof.

11. The method according to claim 1 wherein the non-woven felt of fibrous stem and lamina material are passed through calender rolls before being removed from said continuous wire belt.

12. The method of claim 1 wherein the moisture of said stem is from about 10% to about 60% before said treatment.

13. The method of claim 1, comprising the further step of adding a non-tobacco extender material to the stem parts.

14. The method of claim 1, comprising the further step of adding a non-tobacco extender material to the fine lamina tobacco.

15. The method of claim 1, comprising the further step of adding a non-tobacco extender material to the non-woven felt sheet of fibrous stem and lamina particles.

16. The method of claim 1, comprising the further step of adding a non-tobacco extender material to the mixture of fibrous stem and fine lamina tobacco.

17. A method for manufacturing reconstituted tobacco of tobacco stems and tobacco fines comprising:

a. treating the stem parts of tobacco in essentially dry form to reduce the stem to substantially fibrous fibrous form:

b. treating one or the other of the fibrous tobacco stem or fine lamina tobacco with a suitable chemical, or enzyme to liberate natural pectin material as a binder:

c. mixing the fibrous stem with fine lamina tobacco:

d. conveying the mixture in an air stream and subsequently depositing the mixture of fibrous stem and the fine lamina tobacco on a moving wire continuous belt;

e. passing said air stream through the tobacco mixture on the wire mesh belt for homogenizing the fibrous stem and fine tobacco lamina throughout the mixture and causing intertwining of the fibrous stem and forming a continuous non-woven felt sheet of fibrous stem tobacco and fine lamina tobacco;

f. drying the binder; and, g. removing said non-woven felt sheet of fibrous tobacco stem and fine lamina tobacco in such a form for use in the manufacture of tobacco smoking articles.

18. A method for manufacturing reconstituted tobacco of tobacco stem and tobacco fines comprising:

a. treating the stem parts of tobacco in essentially a dry form to reduce the stem to substantially fibrous form;

b. mixing the fibrous tobacco stem with fine lamina tobacco;

c. adding a binder to the stem and fine lamina tobacco as the stem and fine lamina tobacco are being mixed;

d. conveying the mixture in an air stream and subsequently depositing the mixture of fibrous tobacco stem and fine lamina tobacco or a moving wire mesh continuous belt;

e. passing said air stream through the tobacco mixture or the wire mesh belt for homogenizing the fibrous stem and fine tobacco lamina throughout the mixture and causing intertwining of the fibrous stem and forming a continuous non-woven felt sheet of intertwined fibrous stem and fine lamina tobacco;

f. drying the binder; and, g. removing said non-woven felt sheet of fibrous tobacco stem and fine lamina tobacco in such a form for use in the manufacture of tobacco smoking articles.

* * * * *

UNITED STATES PATENT AND TRADEMARK OFFICE

CERTIFICATE OF CORRECTION

PATENT NO. : 4,681,126

DATED : July 21, 1987

INVENTOR(S) : D. G. Strubel/R. A. Sanford

It is certified that error appears in the above—identified patent and that said Letters Patent is hereby corrected as shown below:

Claim 1, column 6, line 1, "is" should be changed to ---in---;

Signed and Sealed this

Tenth Day of May, 1988

*Attest:*

*Attesting Officer*

DONALD J. QUIGG

*Commissioner of Patents and Trademarks*